United States Patent [19]

Corley et al.

[11] 4,391,660

[45] Jul. 5, 1983

[54] COPPER CONTAINING BALLISTIC ADDITIVES

[75] Inventors: Robert C. Corley, Lancaster, Calif.; Frederick F. Myers, Jr., Manassas, Va.

[73] Assignee: The United States of America as represented by the Secretary of the Air Force, Washington, D.C.

[21] Appl. No.: 300,761

[22] Filed: Sep. 10, 1981

[51] Int. Cl.[3] ..... C06B 45/10

[52] U.S. Cl. ..... 149/19.9; 149/21; 149/42; 149/44; 149/76; 149/113

[58] Field of Search ..... 149/19.9, 21, 76, 113, 149/42, 44

[56] References Cited

U.S. PATENT DOCUMENTS

| | | | |
|---|---|---|---|
| 2,904,420 | 9/1959 | Holker | 52/0.5 |
| 2,923,612 | 2/1980 | Harrison et al. | 52/14 |
| 3,259,531 | 7/1966 | Lofberg | 149/76 |
| 3,314,834 | 4/1967 | Walden et al. | 149/19.4 |
| 3,390,027 | 6/1968 | Olberg et al. | 149/19.4 |
| 3,505,373 | 4/1970 | Olberg et al. | 149/19.4 |
| 3,753,348 | 8/1973 | Burnside | 60/219 |
| 3,841,929 | 10/1974 | Craig | 149/17 |
| 3,870,578 | 3/1975 | Nichols | 149/19.4 |
| 3,874,957 | 4/1975 | Corley et al. | 149/5 |
| 3,960,621 | 6/1976 | Whiteworth et al. | 149/65 |
| 4,098,626 | 7/1978 | Graham et al. | 149/19.9 |

*Primary Examiner*—Stephen J. Lechert, Jr.

*Attorney, Agent, or Firm*—Donald J. Singer; William J. O'Brien

[57] ABSTRACT

This invention concerns itself with the addition of certain copper salts and chelates to solid propellant formulations as burning rate modifiers. The additives increase the burning rate of the propellant while simultaneously decreasing its pressure exponent.

9 Claims, No Drawings

COPPER CONTAINING BALLISTIC ADDITIVES

STATEMENT OF GOVERNMENT INTEREST

The invention described herein may be manufactured and used by or for the Government for governmental purposes without the payment of any royalty thereon.

BACKGROUND OF THE INVENTION

The present invention relates to solid propellants and to ballistic additives for use therewith. More particularly, this invention concerns itself with the use of copper salts as burning rate modifiers for solid rocket propellant compositions.

The increased interest and reliance on solid propellant compositions, because of their relatively long shelf life and ease of handling, has created a considerable research effort in an attempt to develop additives which can materially improve the ballistic properties of solid propellant compositions.

One of the primary factors contributing to the ballistic characteristics of solid propellants is the burning rate of the propellant grains. The grains burn in parallel layers. That is, the burning takes place in a direction perpendicular to the surface of the grain and the rate or speed with which the grains burn is referred to as the burning rate. It has the dimensions of velocity and is one of the most important factors to be considered in designing solid propellant rocket motors.

The burning rate of solid propellants is influenced by a number of factors including the pressure of the gas in contact with the burning surface. The rate increases with pressure creating problems with rocket motors requiring a rather constant burning rate with changing chamber pressure. Therefore, the development of additive materials capable of creating desirable ballistic properties, such as burn rate enhancement with concommitant pressure exponent reduction, becomes a very desirable research objective. In furthering this desirable research objective, it was found that the addition of minor amounts of certain copper salts, increased the burning rate of solid propellant grains together with a significant decrease in the pressure exponent. Heretofore, attempts at increasing the burning rate has increased the pressure exponent, thereby severely limiting the application of the solid propellant and the burning rate additive used to alter its burning rate.

SUMMARY OF THE INVENTION

In accordance with this invention, it has been found that the addition of certain copper compounds to solid propellant compositions can materially increase the burning rate of the propellant grains while simultaneously reducing the pressure exponent in the rocket motor chamber. The copper compounds are simple salts, and various types of chelates. In a baseline 88 weight percent solid propellant formulation, the copper compounds of this invention exhibited ballistic characteristics covering burn rates up to 1.5 in/sec at 1000 psia and pressure exponents down to 0.15.

Accordingly, the primary object of this invention is to develop a concept of incorporating copper compounds into solid rocket propellant formulations for use as burning rate modifiers.

Another object of this invention is to provide ballistic additives that are capable of increasing the burning rate of solid propellant grains while simultaneously decreasing their pressure exponent.

The above and still other objects and advantages of the present invention will become more readily apparent upon consideration of the following detailed description thereof.

DESCRIPTION OF THE PREFERRED EMBODIMENT

Pursuant to the above defined objects, the present invention involves the use of certain copper salts and chelates as burning rate modifiers for solid rocket propellant formulations. The function of a propellant is to produce a gaseous product which in turn imparts motion to a rocket or missile. In producing the gaseous product, the propellant undergoes a combustion reaction which differs for the various types of propellants. The combustion reaction for solid propellants, for example, takes place in parallel layers and proceeds in a direction perpendicular to the surface of the propellant grain. The rate or speed that combustion occurs is referred to as the burning rate and is an extremely important parameter in determining the efficiency of the propellant. An increased burning rate is a desirable characteristic and is most sought after when formulating propellant compositions. Unfortunately, attempts at increasing the burning rate, even when found to be successful, often result in an undesirable increase in the pressure exponant in the rocket motor chamber. This pressure increase severely limits the application of solid propellants and the ballistic modifiers used to alter their burning rate. This problem is especially associated with nozzleless rocket motors that require a rather constant burning rate with changing chamber pressure.

With the present invention, however, it has been found that certain copper compounds, when added in a minor amount to a solid propellant, increase the burning rate of the propellant along with a simultaneous decrease in the pressure exponent. Generally, the additive is incorporated into a conventional solid propellant in amounts of about two weight percent. A typical solid propellant formulation prepared in a conventional manner and containing a plastic binder component, fuel component, oxidizer component and the copper additive component of this invention is illustrated in Example 1.

EXAMPLE 1

| Compound | Weight Percent |
|---|---|
| *HTPB binder | 12 |
| Aluminum powder fuel (MDX-65) | 18 |
| Ammonium perchlorate oxidizer: | |
| 200 Microns in size | 33 |
| 6 Microns in size | 35 |
| Copper Additive | 2 |
| | 100 |

*Hydroxy Terminated Polybutadiene

As stated heretofore, the specific copper containing additives of this invention are simple salts and various types of chelates and are listed listed in Table I.

Table II, on the other hand, sets forth the structural formulus of the components of Table I in order to more specifically identify the additives of this invention.

TABLE I

| Identification No. | Additive |
|---|---|
| 1 | copper thiocyanate |
| 2 | copper chromite |
| 3 | copper stearate |
| 4 | copper ferrocyanide |
| 5 | 2,5-dihydroxy benzoquinone copper (II) polymer |
| 6 | N—substituted benzotriazole complexes |
| 7 | copper Shiff Base with salicylidene ethylene diamine |
| 8 | copper (II) [(salicylaldehyde) (2,4 pentanedione] |
| 9 | tetrachloro-m-[bis dimethyl glyoxamato copper (II)]di copper (II) |

TABLE II

CuSCN (1)

$Cu_2Cr_2O_4$ (2)

$Cu[O_2C(CH_2)_{16}CH_3]_2$ (3)

$Cu_2Fe(CN)_6; \times H_2O$ (4)

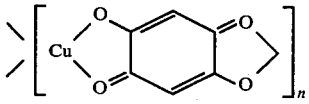

(5)

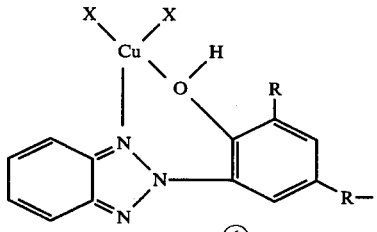

(6)

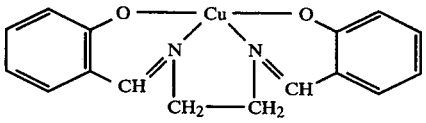

(7)

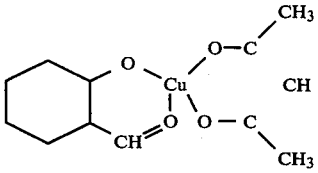

(8)

TABLE II-continued

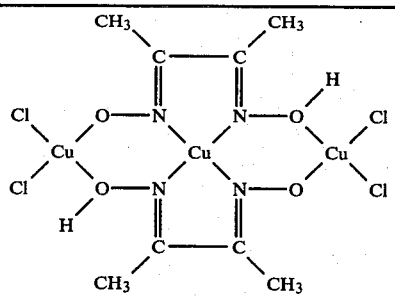

(9)

The copper thiocyanate, copper chromite, copper stearate and copper ferrocyanide additive (compounds 1, 2, 3 and 4 of Table I respectively) are commercially available. Copper thiocyanate may be made by reduction of a copper (II) salt by sulfites followed by precipitation of #1 with a solution of ammonium thiocyanate. Copper ferrocyanide may be made by adding an ammonical copper (II) compound in an aqueous medium to a solution of hexacyanoferrous acid. The hexacyanoferrous acid is prepared by the addition of concentrated HCl to potassium ferrocyanide at 0° C. and extracting the acid with ether.

The 2,5-dihydroxy benzoquinone copper (II) polymer, (Table I, compound 5), Cu(DHBQ) is prepared as follows: Ten g of 2,5-dihydroxy benzoquinone are dissolved in 200 ml of either dimethylformamide (DMF) or tetrahydrofurane (THF). To this is added 14 g of copper acetate (hydrate) dissolved in 250 ml of DMF (or THF). The solution is refluxed for 4 hours. The products have to be centrifuged after being allowed to settle for a few days. The DMF solution yielded a brown product, and the THF yielded a blue product. Since the compounds were insoluble in all common solvents, purification and analysis was difficult. The only purification attempted was Soxhlet extraction using acetone as suggested by Coble and Holizclaw, J. Inorg, Nucl. Chem., 36,1049 (1974). The yield was about 10 g. The chain length is difficult to estimate, but low voltage mass spectral data (20 eV, CEC 450) show masses up to at least 600, indicating the molecule to be at least a trimer. The analytical data indicate copper=31.52% (found 30.2%); carbon=35.58% (found 37.88%; hydrogen=0.99% (found 2.39%. The IR spectra shows a carbonyl shift to 1470 $cm^{-1}$ (from 1640 $cm^{-1}$ in the starting DHBQ) and a loss of the phenolic absorption of 3300 $cm^{-1}$. The fragmentation pattern from a high voltage (70 eV) mass spectral study is shown in Table III.

The N-substituted benzotriazole complexes Table I Compound (6) are made using complexing agents, available commercially from Ciba Giegy under the trade name Tinuvin 326, 324 and 328. Tinuvin 326 is an N-substituted benzotriazole compound in which $R=CH_3$ and $R'$=t-butyl. Tinuvin 324 and 328 show more promise than the Tinuvin 326 due to a greater solubility, but the R groups are unknown. The copper complexes are prepared by mixing copper with equimolar ratios of the Tinuvin compound in THF. Specifically, a ratio of 2.0 grams/2.8 grams for copper acetate/tinuvin compound can be used. The visible spectra of the complexes show a maximum absorption in the 560–570 micron region which suggests a square planar configuration for the copper. The IR spectre show coordination through the phenolic hydroxyls as evidenced by the absorptions at 2950, 1150 and 1250 $cm^{-1}$ which are ascribed to the OH, CO and the phenol, respectively. The low voltage mass spectra show the expected molecular ions in a low abundance (m/e 463 for the Tinuvin 326 complex). The high voltage mass spectra indicate extensive fragmentation of the complexes with cleavage of both aromatic rings. The fragmentation pattern seems to indicate extreme stability of the Cu-H bonds (possible $CuN_3$ species). In view of the unknown commercial nature of the Tinuvin compounds, no exhaustive mass spectral studies were undertaken on these complexes.

The copper Schiff Base with salicylaldehyde ethylene (Table I compound 7), Cusalen, is a well-known compound, see Holm et al, Prog. Inorg. Chem; 7, 82 (1966) or Gilbert et al, J. Amer Chem. Soc., 95, 2476 (1973), which was made as follows. A mixture of salicylaldehyde and ethylene diamine (2:1 mole ratio) in ethanol was refluxed for an hour. To this solution, one mole equivalent of copper acetate in ethanol was added, and the mixture heated for one hour with constant stirring. The precipitated complex was filtered, washed with excess ethanol, and dried in vacuo. The complex was purified by sublimation.

The Copper (II) [(salicylaldehyde) (2.4-pentanedione)] additive (Table I, compound (8), Cu (sal:acac) was made according to Doraswamy et al, J. Inorg, Nucl. Chem, 37, 1665 (1975) in an alcoholic solution by mixing cupric chloride, salicylaldehyde and 2,4-pentanedione in a 1:1:1 mole ration. The mixture was stirred and the pH adjusted to 5.5 with an ammonia solution. The green solid was washed with alcohol/water and recrystallized from chloroform. IR analysis shows the absence of the hydroxyl band and a carbonyl shift from 1625 $cm^{-1}$ to 1580 $cm^{-1}$. The fragmentation pattern from the mass spectral study is shown in Table IV.

The tetrachloro-u-(bis dimethyl glyoxamato Copper (II) di copper (II) cluster complex (Table I Compound 9), $Cu(DMG)_2:(CuCi_2)_2$ made by, the procedure of Singh et al, J. Inorg, Nuci. Chem., 36, 1259 (1974). In short, dimethyl glyoxamato Cu (II) was made from copper acetate and dimethyl glyoxime in alcohol. To this was added cupric chloride. The brownish-green crystals were allowed to settle overnight, filtered and washed with alcohol and ether. The shift of the C=N frequency (DMG at 1450, Cu(DMG) at 1590, and the complex at 1515 $cm^{-1}$) and the NO frequency (990, 925 to 1200, 1100 to 1050 respectively) clearly indicate complxation. These results are in agreement with the proposed trinulcear structure. Elemental analysis gave: Cu cale 33.69% (found 32.80%), carbon calc 17.05% (found 16.09%), hydrogen calc 17.05% (found 15.99%), and nitrogen calc 10,000% (found 9.20%). The fragmentation pattern from the mass spectral study is shown in Table V.

TABLE III

| m/e | Relative intensity | Assignment |
|---|---|---|
| 63 | 100 | cu |
| 79 | 4 | CuO |
| 91 | 35 | CuCO |
| 105 | 11 | $CUC(O)CH_2$ or CuoC = CH2 |
| 121 | 50 | $CH_2OCuCO$ |
| 155 | 4 | 7 |
| 181,182 | 9 | CuCO COCu 7 |
| 201 | 3 | P |

TABLE III-continued

| m/e | Relative intensity | Assignment |
|---|---|---|
| 402 | 1 | $P_2$ |

TABLE IV

| m/e | Relative intensity | Assignment |
|---|---|---|
| 63 | 41 | Cu |
| 105 | 19 | $CuCOCH_3$ |
| 123 | 70 | $Cu(OCH_2)_2$ |
| | | $CuOCH(CH_3)$ +H |
| 120 | 61 | $-CH_2$ |
| 110 | 100 | |
| 133 | 3 | $-CH_3$ |
| 147 | 41 | |
| | | Cu(acac) |
| | | $-2CH_3$ |
| 162 | 27 | + (acac) |
| 201 | 2 | $-CH_3$ $-CH_2CO$ |
| 219 | 2 | |
| 231 | 19 | $-CH_3$ |
| 246 | 18 | |
| 261 | 25 | $Cu(acac)_2$ |

TABLE V

| m/e | Relative intensity | Assignment |
|---|---|---|
| 63 | 100 | Cu |
| 91 | 10 | $CuN_2$ |
| 94 | 18 | CuNOH |
| 106 | 25 | CuNCO |
| 120 | 5 | $CuNOCCH_3$ |
| 121 | 19 | $CuNOHCCH_3$ |
| 134 | 75 | $CuCl_2$ |
| 162 | 13 | $Cu(DHG)—CH_2$ |
| 169 | 6 | |
| 206 | 20 | |
| 236 | 1 | |
| 235 | 4 | |
| 263 | 2 | $Cu(DMG)—2CH_2$ |
| 268 | 1 | $CuCl_2$ dimer |

The present invention provides ballistic additives that may be used in solid rocket motor propellants to give better control over ballistics than is currently possible. The additives of this invention allow the formulation of propellants that have reduced pressure exponents. That, in turn, allows rocket motor designers more latitude in selecting grain designs and allows the use of lighter weight inert compounds. The additives were tested in propellant burn rate strands. The result of their tests are shown in Table VI.

TABLE VI

| Additive No | Burn Rate (in./sec) 1000 psia | Stage |
|---|---|---|
| 1 | .49 | .4 |
| 2 | 1.19 | .33 |
| 3 | .53 | .13 |
| *3 + A02246 | .48 | .09 |
| **3 + Schiff Base | .58 | .18 |
| 4 | 1.47 | .15 |
| 5 (Blue) | .59 | .46 |
| 5 (Brown) | .5 | .9 |
| 6 (324) | .42 | .43 |
| 6 (328) | 1.1 | .27 |
| 7 | .55 | .20 |
| 8 | .86 | .17 |

TABLE VI-continued

| Additive No | Burn Rate (in./sec) 1000 psia | Stage |
|---|---|---|
| 9 | .69 | .80 |

*A02246 is 2,2'-methylene-bis (4-methyl-6-t-butylphenol)
**A 50/50 mix of salicylaldehyde and ethylenediamine.

From the foregoing description, it becomes apparent that the present invention is most effective in increasing the burning rate of solid propellant formulations while simultaneously lowering the pressure exponent. The invention provides a novel means for enhancing burn rates and overcomes the problems of increased pressure encountered when using previously known additives.

While the invention has been described with particular reference to specific embodiments thereof, it is to be understood that the present disclosure has been made by way of illustration only and that numerous changes and alterations in the details of this invention may be resorted to without departing from the spirit and scope of the appended claims.

We claim:

1. In a solid propellant formulation composed of a plastic binder component, a fuel component and an oxidizer component, the improvement which comprises the addition of a minor amount of a copper containing additive selected from the groups consisting of copper thiocyanate, copper ferrocyanide, 2,5-dihydroxy benzoquinone copper (II) polymer, an N-substituted benzotriazol copper acetate complex, a copper Schiff Base with salicylidene ethylene diamine, copper (II) [(salicylaldehyde) (2,4-pentanedione)], and tetrachloro u-[bis dimethyl glyoxamate copper (II)]di copper (II).

2. In a solid propellant formulation according to claim 1 wherein said improvement comprises the addition of about two weight percent of the copper containing additive.

3. In a solid propellant formulation in accordance with claim 2 wherein said copper containing additive is copper thiocyanate.

4. In a solid propellant formulation in accordance with claim 2 wherein said copper containing additive is copper ferrocyanide.

5. In a solid propellant formulation in accordance with claim 2 wherein said copper containing additive is 2,5-dihydroxy benzoquinone copper (II) polymer.

6. In a solid propellant formulation in accordance with claim 2 wherein said copper containing additive is an N-substituted benzotriazol copper acetate complex.

7. In a solid propellant formulation in accordance with claim 2 wherein said copper containing additive is a copper Schiff Base with salicylidene ethylene diamine.

8. In a solid propellant formulation in accordance with claim 2 wherein said copper containing additive is copper (II) [(salicylaldehyde) (2,4-pentanedione)].

9. In a solid propellant formulation in accordance with claim 2 wherein said copper containing additive is tetrachloro-u-[bis dimethyl glyoxamate copper (II)]di copper (II).

* * * * *